US007871256B2

(12) United States Patent
Techlin et al.

(10) Patent No.: US 7,871,256 B2
(45) Date of Patent: Jan. 18, 2011

(54) CABLE GUIDE SYSTEM FOR A MOLD FORMING AND EXTRUDING MACHINE AND A METHOD OF USE

(75) Inventors: Aaron A. Techlin, Appleton, WI (US); Graham M. Conradt, Greenville, WI (US); Tyler N. Techlin, Appleton, WI (US)

(73) Assignee: Curb Solutions, LLC, Appleton, WI (US)

( * ) Notice: Subject to any disclaimer, the term of this patent is extended or adjusted under 35 U.S.C. 154(b) by 0 days.

(21) Appl. No.: 12/381,040

(22) Filed: Mar. 6, 2009

(65) Prior Publication Data

US 2010/0225015 A1 Sep. 9, 2010

(51) Int. Cl.
*E01C 11/22* (2006.01)
*E01C 19/00* (2006.01)
*E01F 9/053* (2006.01)

(52) U.S. Cl. ..... 425/64; 425/114; 425/122; 425/185; 264/35

(58) Field of Classification Search ..... 425/64, 425/114, 115, 117, 122, 185; 264/35
See application file for complete search history.

(56) References Cited

U.S. PATENT DOCUMENTS 3,421,419 A 1/1969 Adcock
3,600,773 A 8/1971 Davis et al.
3,616,496 A * 11/1971 Angioletti ..... 425/113
3,657,977 A 4/1972 Hudis
3,792,133 A 2/1974 Goughnour
3,926,541 A * 12/1975 Hewitt ..... 425/64
3,979,171 A * 9/1976 Nagy ..... 425/64
4,067,676 A * 1/1978 Hewitt ..... 425/64
4,084,928 A 4/1978 Petersik
4,125,348 A * 11/1978 Martens ..... 425/64
4,132,492 A * 1/1979 Jenkins ..... 404/119
4,310,293 A 1/1982 Eggleton (Continued)

OTHER PUBLICATIONS

Lil Bubba LB Curb Machines, Cable Feed Kit, Cable Feed Attachment, website, www.lilbubba.com/shop/scripts/prodView.asp?idproduct=341, printed Feb. 17, 2009, 2 pages.

(Continued)

*Primary Examiner*—Joseph S Del Sole
*Assistant Examiner*—Nahida Sultana
(74) *Attorney, Agent, or Firm*—Thomas J. Connelly; Wilhelm Law, S.C.

(57) ABSTRACT

A cable guide system and method are disclosed for a mold forming and extruding machine. The machine has a pair of spaced apart vertical members. The cable guide system includes a support shaft secured to the pair of vertical members. The support shaft retains a first stop member, a tensioning device, a spool loaded with a flexible reinforcement cable, and a second stop member. The spool cooperates with the tensioning device to prevent the cable from prematurely unraveling. The cable guide system further includes a guide member located below and forward of the spool and in horizontal alignment with a plunger. The guide member is capable of changing the direction of the flexible reinforcement cable as it is unwound from the spool. The plunger is capable of extruding a moldable substance from the machine while allowing the flexible reinforcement cable to pass through an aperture formed therein.

17 Claims, 5 Drawing Sheets

U.S. PATENT DOCUMENTS

| | | | | |
|---|---|---|---|---|
| 4,312,602 | A | 1/1982 | Dale | |
| 4,383,810 | A * | 5/1983 | Bunn et al. | 425/122 |
| 4,533,091 | A * | 8/1985 | Knight et al. | 242/129.6 |
| 4,742,970 | A | 5/1988 | Barazone | |
| 6,293,728 | B1 | 9/2001 | Eggleton et al. | |
| 6,540,435 | B1 | 4/2003 | Lizarraga | |
| 6,820,723 | B2 * | 11/2004 | Huber | 182/127 |
| 6,863,470 | B2 | 3/2005 | Eggleton et al. | |
| 6,932,294 | B1 * | 8/2005 | Larson | 242/390.5 |
| 2001/0001780 | A1 * | 5/2001 | Hanna | 493/459 |
| 2002/0021938 | A1 | 2/2002 | Matthias et al. | |
| 2002/0075470 | A1 * | 6/2002 | Ishizuka | 355/72 |
| 2010/0239371 | A1 * | 9/2010 | Brown | 405/3 |

OTHER PUBLICATIONS

Boarderline Stamp, Inc., Video Training and Training at Boarderline Headquarters, Curbing Instruction, website, www.boarderlinestamp.com/p_training.htm, printed Feb. 17, 2009, 3 pages.

* cited by examiner

CABLE GUIDE SYSTEM FOR A MOLD FORMING AND EXTRUDING MACHINE AND A METHOD OF USE

FIELD OF THE INVENTION

This invention relates to a cable guide system for a mold forming and extruding machine which can extrude a moldable substance along with a flexible reinforcement cable and a method of unwinding and positioning the cable within the mold substance.

BACKGROUND OF THE INVENTION

In the past decade, it has become common for many residential and commercial property owners to have a continuous custom concrete curb or edging installed around flower beds, trees gardens, etc. to enhance the appearance of their landscaping. The continuous concrete curb or edging is formed using a portable curb forming and extruding machine such as those manufactured by "Borderline Stamp. Inc." of Surprise, Ariz., and "The Concrete Edge Company" of Orlando, Fla., as well as others. Such machines typically include a reciprocating ram or an auger to force concrete or other building materials through a mold. Each machine includes a hopper for receiving the material and a motor and gear box for driving the ram or auger.

In addition, several different kinds of mold units can be affixed to the extruding machines so as to form concrete or asphalt walkways, speed bumps, automobile stops in parking lots, etc.

It has been recognized that over time, after the continuous mold has been installed, that it may be acceptable to cracking and breaking. Such cracking and breaking can occur for a number of reasons. In general, the makeup of a particular soil, movement of the ground, shifting soil, ground tremors, earthquakes, soil erosion, etc. can affect a concrete mold. In addition, in southern climates, a mold can crack or break due to the consistency of the soil, the amount of clay and/or sand in the soil. In northern climates, a large fluctuation in temperatures can cause the ground to heave or move due to freezing and thawing. For example, a severe winter in parts of Minnesota, Wisconsin, Michigan or upstate New York, where frost is common, can cause the upper layer of the soil to move or heave. This movement can easily cause a continuous concrete mold having a height of less than about eight inches to heave, crack and/or break. It is not uncommon to see a continuous mold heave or fall two to three inches from its original elevation due to the action of frost. Another cause of such cracking and breaking can occur if an automobile or truck drives over the curb or edging. Furthermore, certain soils are more prone to settling due to soil erosion, water runoff, wind, etc. and this too can cause the continuous mold to crack or break at various locations. When the continuous mold does crack or break, the top and/or side surfaces of adjoining sections can acquire a step or shoulder appearance which is unsightly. Such an uneven and unsightly appearance destroys the aesthetic appearance of the continuous mold.

One solution to preventing or minimizing such cracking and breaking from occurring over time is to embed one or more flexible reinforcement cables or wires in the continuous mold as it is being formed. The flexible reinforcement cables or wires can be formed from various materials and should extend along the length of the continuous mold. The flexible reinforcement cables or wires can vary in diameter but should be of sufficient strength to provide reinforcement to the continuous mold.

In the past, reinforcement cables and wires have been incorporated into concrete and asphalt sidewalks, driveways, curbing, edging, speed bumps, etc. to prevent cracking and breaking. The most common way of accomplishing this was to form a crisscross pattern of rigid reinforcement rods and to position the rods on the ground before the concrete was poured. This works well for large concrete sections like driveways and walkways but does not lend itself to an elongated narrow strip of curbing or edging. Some contractors have also tried to insert rigid reinforcement rods into curbs and edgings but this had its drawbacks especially when the curb or edging was molded into a curve or circular shape. Because of this, contractors have transitioned away from rigid reinforcement rods to the use of flexible cables so that they could form non-linear shapes. Some contractors have attempted to embed a flexible cable by cutting it to a length approximately equal to the length of the continuous mold which is to be formed. The cable or wire was then routed through a portion of the extrusion mold and was secured to the ground at a starting point. The concrete was then extruded from the mold forming machine onto the top of the cable. This process had three major drawbacks. First, it was inefficient in that the cable had to be first cut and positioned in place. Second, the cable was pushed downward against the ground by the weight of the moldable material. With the reinforcing cable located adjacent to the ground, the cable may not be able to reduce separation of the mold at points where cracking does occur. Third, if the cable was initially cut too short, there was no easy way to add additional cable. This meant that a portion of the finished curb or edging was void of any reinforcement cable.

Accordingly, there is currently a need for a cable guide system for a mold forming and extruding machine. There is also a need for a method which can automatically feed a sufficient amount of cable into an extruded moldable substance such that continuous molds of various shapes and lengths can be formed. There is also a need for a cable guide system for a mold forming and extruding machine that can regulate and maintain the height level of a flexible reinforcement cable or wire within the finished continuous mold. Furthermore, there is a need for a cable guide system for a mold forming and extruding machine that can form an elongated, continuous curb or edging which may have both linear and non-liner sections, or may contain extreme curves, such as tight circles having a diameter of only a few feet.

SUMMARY OF THE INVENTION

Briefly, this invention relates to a cable guide system for a mold forming and extruding machine. The mold forming and extruding machine has a pair of spaced apart vertical members. The cable guide system includes a support shaft aligned horizontally and secured to the pair of spaced apart vertical members. The support shaft has first and second members. The first member has a first end which can be removably attached to one of the vertical members and a second end having an elongated hollow cavity formed therein. The second member has a first end which is sized and shaped to engage with the elongated hollow cavity and a second end which is removably attached to the other vertical member. The first and second members cooperate to vary the length of the support shaft so as to accommodate various machine models. The cable guide system also includes a first stop member secured to the support shaft and a spool containing a quantity of flexible reinforcement cable or wire. The spool has a central aperture formed therethrough which is sized to slide over the support shaft. A tensioning device is positioned on the support shaft and cooperates with the first stop member. The tensioning device is capable of applying a predetermined tension against the spool to prevent the flexible cable or wire from prematurely unraveling. The cable guide system further includes a second stop member secured to the support shaft on an opposite side of the spool. Lastly, the cable guide system includes a guide member secured to the mold forming and extruding machine at a location below and forward of the spool and in horizontal alignment with a plunger having an aperture formed therethrough. The plunger is capable of expelling a moldable substance from the machine while allowing the flexible cable to pass through the aperture. The guide member is capable of changing the direction of the flexible cable or wire which is unwound from the spool from a vertical orientation to a horizontal orientation. The guide member also functions to axially align the unwound cable with the aperture formed in the plunger.

A method of using the cable guide system with a mold forming and extruding machine to guide and embed a flexible cable or wire in a compacted and moldable substance is also taught. The mold forming and extruding machine has a pair of spaced apart vertical members. The method includes attaching the cable guide system to the mold forming and extruding machine. The cable guide system includes a support shaft which is aligned horizontally and secured to the pair of spaced apart vertical members. The support shaft has first and second members. The first member has a first end which is removably attached to one of the vertical members and a second end having an elongated hollow cavity formed therein. The second member has a first end which is sized and shaped to engage with the elongated hollow cavity and a second end which is removably attached to the other vertical member. The first and second members cooperate to vary the length of the support shaft so as to accommodate various machine models. The cable guide system also includes a first stop member secured to the support shaft and a spool containing a quantity of flexible reinforcement cable. The spool has a central aperture formed therethrough which is sized to slide over the support shaft. A tensioning device is positioned on the support shaft and cooperates with the first stop member. The tensioning device is capable of applying a predetermined tension against the spool to prevent the flexible cable from prematurely unraveling. The cable guide system further includes a second stop member secured to the support shaft on an opposite side of the spool. The cable guide system also includes a guide member secured to the mold forming machine at a location below and forward of the spool and in horizontal alignment with a plunger having an aperture formed therethrough. The method further includes unwinding the flexible cable from the spool and threading a free end of the cable through the aperture formed in the guide member. The guide member is capable of changing the direction of the flexible cable which is unwound from the spool from a vertical orientation to a horizontal orientation. The method further includes advancing the free end of the flexible cable through the aperture formed in the plunger such that the flexible cable is axially aligned with the aperture formed in the guide member. Lastly, the method includes securing the free end of the flexible cable to a stake and operating the machine to move away from the stake while the plunger expels the moldable substance around the flexible reinforcement cable or wire.

The general object of this invention is to provide cable guide system for a mold forming and extruding machine. A more specific object of this invention is to provide a method of using the cable guide system.

Another object of this invention is to provide a cable guide system which can be fitted to various models of mold forming and extruding machines.

A further object of this invention is to provide a cable guide system which is easy to attach to a mold forming and extruding machine.

Still another object of this invention is to provide a cable guide system which is easy and efficient to operate.

Still further, an object of this invention is to provide a cable guide system which can position one, two or more flexible reinforcement cables or wires within a compacted and moldable substance which is being extruded from a mold forming machine.

Other objects and advantages of the present invention will become more apparent to those skilled in the art in view of the following description and the accompanying drawings.

DETAILED DESCRIPTION OF THE INVENTION

Figure 1:
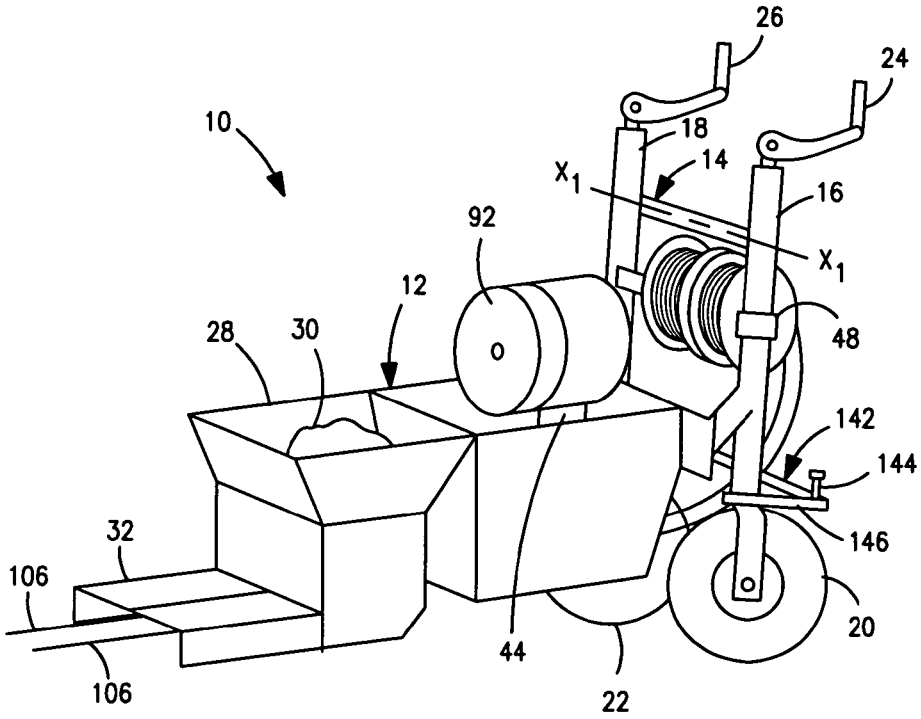
FIG. 1 is a perspective view of a mold forming and extruding machine in accordance with this invention.
Figure 2:
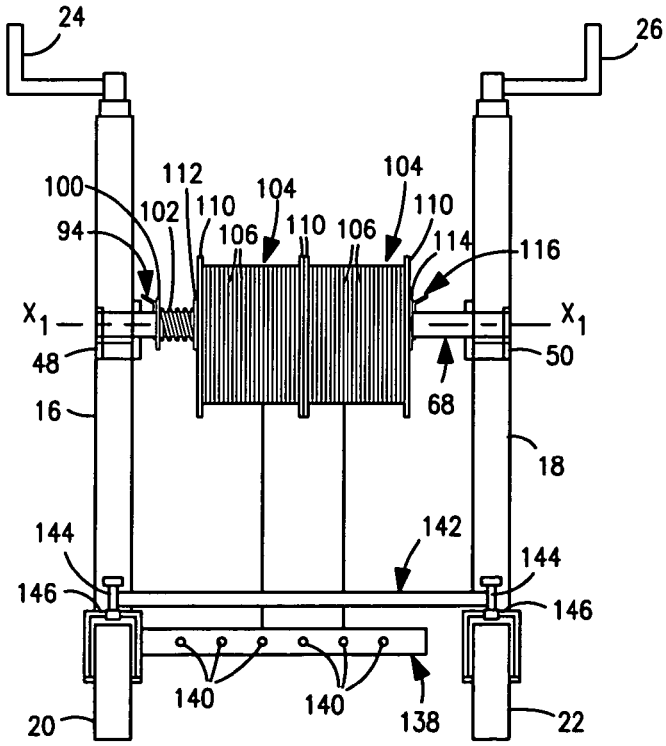
FIG. 2 is a rear view of the mold forming and extruding machine shown in FIG. 1 depicting a pair of spools each retaining a quantity of flexible reinforcement cable or wire.
Figure 3:
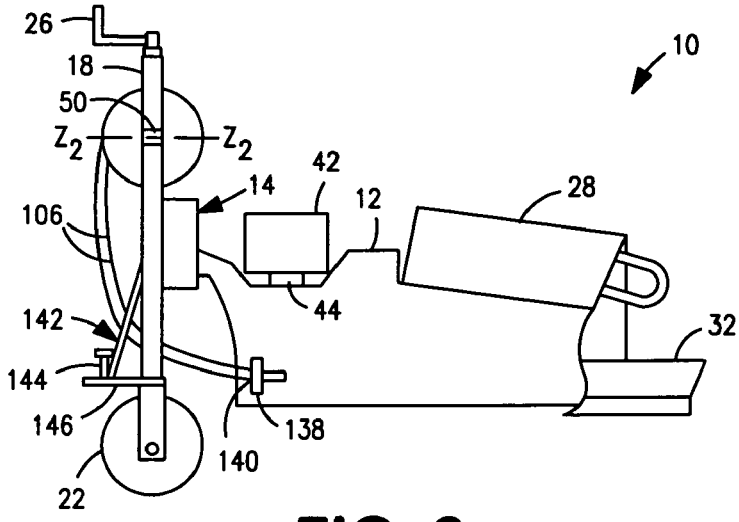
FIG. 3 is a side view of the mold forming and extruding machine shown in FIG. 1 depicting the location of the guide member and the direction of travel of the unwound flexible reinforcement cable or wire.

Referring to FIGS. 1-3, a cable guide system 10 for a mold forming and extruding machine 12 is shown. The machine 12 can be various models of a mold forming and extruding machine 12 which can accommodate different mold units so as to mold curbs, edgings, speed bumps, walkways, sidewalks, etc. The machine 12 includes a frame 14 having a pair of spaced apart vertical members 16 and 18. A pair of rotatable wheels 20 and 22 is secured to a lower portion of the frame 14. Desirably, each of the pair of wheels 20 and 22 is located at the lower end of one of the vertical members 16 and 18. A pair of rotatable handles, 24 and 26, is located at the upper end of each of the vertical members 16 and 18. Each of the handles 24 and 26 is connected to a mechanical mechanism, such as a worm and gear mechanism, not shown, which will enable the frame 14 to be raised or lower with respect to the ground. For example, when the handles 24 and 26 are rotated in a first direction, say clockwise, the frame 14 will be raised farther off of the ground via the pair of wheels 20 and 22, and when the handles 24 and 26 are rotated in an opposite direction, counterclockwise, the frame 14 will be lowered towards the ground via the pair of wheels 20 and 22. Each of the handles 24 and 26 can be operated independently.

The mold forming and extruding machine 12 also includes a steering mechanism 25. The steering mechanism 25 has a movable handle 27 which is connected to a connecting rod 29. The connecting rod 29 spans between the pair of wheels 20 and 22. As the operator moves the handle 27 a set amount in a first direction, the wheels 20 and 22 will turn a corresponding amount in that direction. As the handle 27 is moved a set amount in an opposite direction, the wheels 20 and 22 will turn a corresponding amount in an opposite direction. The steering mechanism 25 can be a mechanical mechanism that functions to allow the operator to guide the machine 12 in a straight, curved or circular path. The mold forming and extruding machine 12 is designed to be guided backward as a curb or edging is being extruded out the front end of the machine 12. Typically, as the extruded mold exits the front end of the machine 12, the machine 12 is urged backward away from the newly created mold.

The frame 14 of the mold forming and extruding machine 12 also supports a hopper 28 into which a moldable substance 30 can be placed. The moldable substance 30 can be any substance that can set and cure over a relatively short period of time. Most likely, the moldable substance 30 is concrete, a fast drying concrete, asphalt or some other building material known to those skilled in the art. Desirably, the moldable substance 30 is concrete. The moldable substance 30 can be in a solid, a semi-solid or a semi-liquid when it is placed in the hopper 28. The moldable substance 30 should be formulated to cure over time into a solid mass. A normal curing time is less than about eight hours at a temperature of about 70° Fahrenheit. Normally, the moldable substance 30 is hand shoveled into the hopper 28 and is a relatively fast curing concrete. The moldable substance 30 can contain various additives to assist in curing and setting. A coloring agent can also be added to the moldable substance 30 to provide a particular color.

The cable guide system 10 of this invention can be constructed to fit new mold forming and extruding machines 12 which are currently being built by original equipment manufacturers (OEM's) or they can be retrofitted onto existing mold forming and extruding machines 12 which have already been sold to curb and edging contractors.

Figure 4:
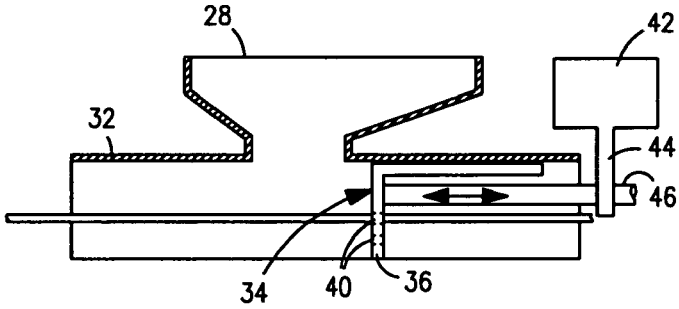
FIG. 4 is a cross-sectional view of a hopper connected to a tunnel shaped mold and having a reciprocating plunger positioned in the mold which is moved by a ram rod.
Figure 5:
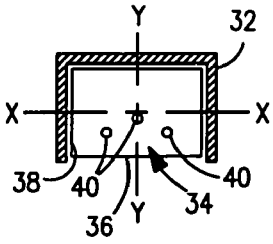
FIG. 5 is a front view of the plunger positioned within the mold unit and depicting three cable apertures formed therein.

Referring now to FIGS. 1, 4 and 5, the mold forming and extruding machine 12 also has a tunnel shaped mold 32 which communicates with the hopper 28. A plunger 34 is movably positioned within the tunnel shaped mold 32. The plunger 34 includes a vertical face member 36 having an outer perimeter 38. The vertical face member 36 also has at least one aperture 40 formed therethrough. Desirably, the vertical face member 36 has two or more spaced apart apertures 40 formed therethrough. The plunger 34 can be connected to a reciprocating ram 46, see FIG. 4, which when activated will cause the plunger 34 to reciprocate back and forth. The speed at which the plunger 34 can reciprocate can be varied to suit one's particular needs.

It should be understood by those skilled in the art that the plunger 34 could be replaced with a rotatable auger (not shown). The auger would force the moldable substance 30 through the tunnel shaped mold 32 as it is rotated. If an auger is utilized, a single aperture could extend through the entire length of the auger so as to allow a flexible reinforcement cable or wire to pass therethrough.

Still referring to FIGS. 4 and 5, three apertures 40 are depicted in the plunger 34. Each of the apertures 40 extends completely through the vertical face member 36 of the plunger 34. Each of the apertures 40 is sized and shaped to allow a flexible cable or wire to easily pass therethrough without binding. Typically, each of the apertures 40 is sized to be at least 0.1 inches larger that the diameter of the flexible cable or wire which is designed to pass therethrough. More desirably, each of the apertures 40 is sized to be at least 0.25 inches larger that the diameter of the flexible cable or wire which is designed to pass therethrough. Even more desirably, each of the apertures 40 is sized to be at least 0.5 inches larger that the diameter of the flexible cable or wire which is designed to pass therethrough. Each of the apertures 40 can have any geometrical configuration. Desirably, each of the apertures 40 has a circular configuration and is sized to be at least 0.15 inches larger that the diameter of the flexible cable or wire which is designed to pass therethrough.

The actual number of apertures 40 formed in the plunger 34 can vary. Desirably, one, two, three or more apertures 40 are present. Three apertures 40, 40 and 40 are depicted in FIG. 5. However, four of more apertures 40 can be present, if desired. All of the apertures 40 do not have to be utilized at the same time. In other words, three apertures 40 can be present in the vertical face member 36 but the mold forming and extruding machine 12 can be depositing only one flexible reinforcing cable or wire into the extruded mold. Each of the other two apertures 40 would simply not have a cable or wire passing through them for that particular time. The overall diameter or size of each of the apertures 40 is relatively small, usually less than about 1 inch, more desirably, less than about 0.5 inches, and even more desirably, less than about 0.35 inches. Because each of the apertures 40 is relatively small when compared to the overall surface area of the vertical face member 36, they do not diminish the ability of the plunger 34 to extrude the moldable substance 30 through the tunnel shaped mold 32. As the surface area of the vertical face member 36 increases, more than three apertures 40 can be formed therein.

Still referring to FIG. 5, the vertical face member 36 of the plunger 34 is shown having a horizontal central axis X-X and a vertical central axis Y-Y. Each of the apertures 40 can be located below the horizontal central axis X-X. When only one aperture 40 is present, it should be located at the intersection of the horizontal central axis X-X and the vertical central axis Y-Y. Desirably, each of the apertures 40 is formed through a lower half of the vertical face member 36. This will ensure that the flexible reinforcement cable or wire will be completely embedded in the newly extruded mold and can provide adequate support to the newly cured mold. When two apertures 40 are present, they can be equally spaced from the vertical central axis Y-Y.

Each of the apertures 40 can vary in configuration but a circular opening with a defined diameter works well. Typically, the diameter of each of the apertures 40 will be less than about 1 inch. Desirably, the diameter of each of the apertures 40 will be less than about 0.5 inches. More desirably, the diameter of each of the apertures 40 will be less than about 0.4 inches. Even more desirably, the diameter of each of the apertures 40 will be less than about 0.35 inches. Each of the apertures 40 should be located at least about 0.5 inches inward from the outer perimeter 38. Desirably, each of the apertures 40 should be located at least about 0.75 inches inward from the outer perimeter 38. Even more desirably, each of the apertures 40 should be located at least about 1 inch inward from the outer perimeter 38. In addition, when two or more apertures 40 are present, each aperture 40 should be spaced from an adjacent aperture 40 by at least about 0.75 inches, desirably by at least about 1 inch, and most desirably, by at least about 1.25 inches.

It should be understood that normally each aperture 40 is sized to allow one flexible reinforcement cable or wire to easily pass therethrough. However, two flexible reinforcement cables or wires could be passed through at least one of the apertures 40 if that is what the operator wishes to do and if the aperture 40 had a sufficiently large diameter. Typically, no two flexible reinforcement cables or wires will touch or contact one another within the newly extruded mold. However, in some situations, this may be a desirable feature. By arranging the aperture(s) 40 in the manor described above, one can be assured that one or more flexible reinforcement cables or wires can be completely embedded within the moldable substance 30 and that they will be able to perform their intended function. In addition, by arranging the flexible reinforcement cables or wires inward from the outer perimeter 38, they will not be visible to the naked eye in the finished mold. By retaining the flexible reinforcement cables or wires approximately at the lower half of the finished extruded mold, one can be confidence that the flexible reinforcing cables or wires will perform their intended function and limit cracking, breaking, separating or heaving of the finished mold over time.

Returning again to FIGS. 1, 3 and 4, the mold forming and extruding machine 12 further includes an engine or motor 42 which is supported on the frame 14. The engine or motor 42 is connected by a drive mechanism 44 to a reciprocating ram 46. By "reciprocating ram" it is meant a device that can move back and forth along a common axis or along a path including horizontal and vertical vectors. A pendulum, a swing arm, a cam operated elliptical path, etc. represent some ways in which the reciprocating ram 46 can be driven. The reciprocating ram 46 in turn is attached to the plunger 34. The engine or motor 42 can be a common gasoline or diesel engine, a two or four stroke motor, etc. The drive mechanism 44 can be any type of mechanical, hydraulic or pneumatic device. For example, the drive mechanism 44 could be a gear box with two or more intermeshing gears, a drive train, a belt drive, a hydraulic cylinder, a pneumatic cylinder, etc. Those skilled in the art will know of other forms of drive mechanisms 44 that can also be utilized. The engine or motor 42, the drive mechanism 44 and the reciprocating ram 46 are connected such that the plunger 34 will reciprocate back and forth when the engine or motor 42 is turned on and running. Various clutches, transmissions, gears and brakes can be employed to regulate when the plunger 34 operates and at what speed. The speed at which the plunger 34 reciprocates and the force that the plunger 34 applies against the moldable substance 30, which is introduced into the tunnel shaped mold 32 from the hopper 28, can vary. Various gearing, cams, levers, arms, bushings, pivot points, etc. can be utilized to vary these parameters as is well known to those skilled in the art.

Figure 7:
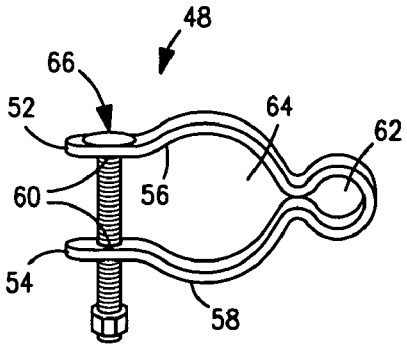
FIG. 7 is a top view of one of the pair of brackets along with a carriage bolt and nut used to secure the support shaft to the pair of spaced part vertical members of the mold forming and extruding machine.
Figure 8:
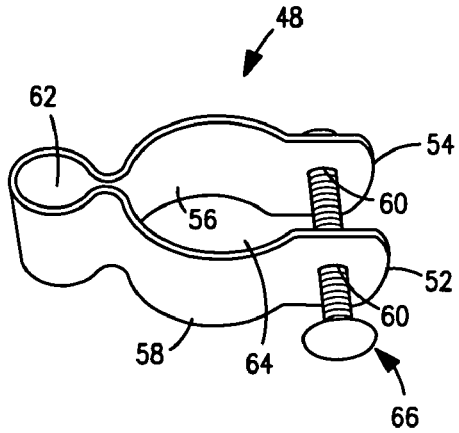
FIG. 8 is a perspective view of the bracket, carriage bolt and nut shown in FIG. 7 and rotated 180 degrees.
Figure 9:
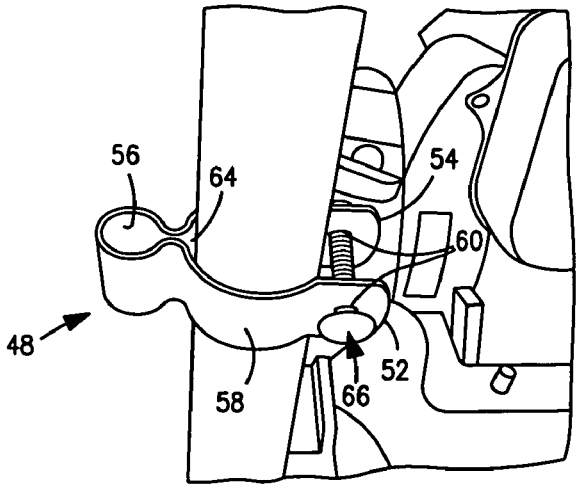
FIG. 9 is a perspective view of the bracket, carriage bolt and nut shown in FIG. 8 depicting the bracket secured to one of the vertical members.

Referring now to FIGS. 1, 2 and 7-9, the cable guide system 10 includes a pair of brackets 48 and 50 each being adjustably mounted onto one of the pair of vertical members 16 and 18, see FIG. 2. Each of the pair of brackets 48 and 50 can be formed from any type of material. Desirably, each of the pair of brackets 48 and 50 is formed from a metal, such as steel or galvanized steel. Each of the pair of brackets 48 and 50 has a first end first 52, a second end 54, an inner surface 56 and an outer surface 58. Each of the first and second ends, 52 and 54 respectively, has an opening 60 perpendicularly formed therethrough. Each of the pair of brackets 48 and 50 is shaped, such as by bending, to form a first cavity 62 and a larger second cavity 64. The first cavity 62 is located adjacent to the second cavity 64. The first cavity 62 extends from between about 320° to about 350° of a complete circle and has a small opening that leads into the second cavity 64. The second cavity 64 extends from between about 280° to about 330° of a complete circle and is open at one end. The first and second ends, 52 and 54 respectively, establish the opening in the second cavity 64. The opening in the second cavity 64 is relatively large so as to allow each of the pair of brackets 48 and 50 to be positioned on one of the vertical members 16 or 18. Each of the pair of brackets 48 and 50 contains some spring tension such that the first and second ends, 52 and 54 respectively, can be temporarily pulled away from one another so as to fit onto the vertical members 16 and 18. The first and second cavities, 62 and 64 respectively, extend vertically through each of the pair of brackets 48 and 50 and are open at each end. The first and second cavities, 62 and 64 respectively, are aligned perpendicular to the inner and outer surfaces 56 and 58 respectively. The first and second ends, 52 and 54, of each of the pair of brackets 48 and 50 are spaced apart from one another. The second cavity 64 of each of the pair of brackets 48 and 50 is capable of fitting over and surrounding at least a portion of one of the spaced apart vertical members 16 and 18. Each of the pair of brackets 48 and 50 can be secured to one of the vertical members 16 or 18 by an attachment mechanism 66. The attachment mechanism 66 can be almost any type of attachment device. As depicted in FIGS. 7-9, the attachment mechanism 66 includes a carriage bolt and a nut. However, almost any type of attachment mechanism 66 known to those skilled in the art can be used. Each of the pair of brackets 48 and 50 can be vertically mounted onto one of the vertical members 16 and 18 at a predetermined height so that they can retain a support shaft 68. Desirably, the support shaft 68 is aligned horizontally between the pair of brackets 48 and 50, see FIG. 2. The pair of brackets 48 and 50 can be removed and be secured to another machine 12 at any time. The shape and configuration of the pair of brackets 48 and 50 enable then to be easily removed and mounted to another machine 12 depending upon the particular job that is to be performed.

Figure 10:
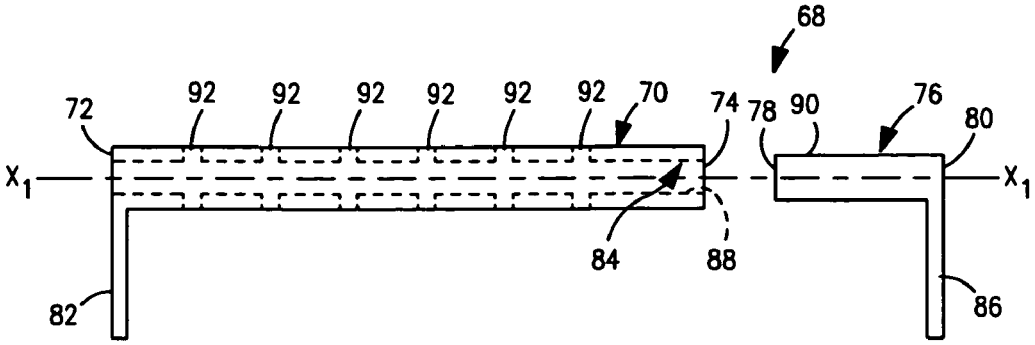
FIG. 10 is a plan view of the first and second members which cooperate to form the support shaft.
Figure 11:
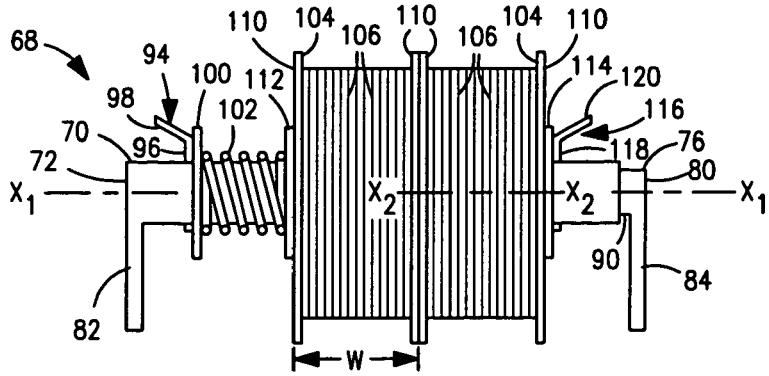
FIG. 11 is an assembly view showing a pair of spools, each retaining a quantity of flexible reinforcement cable or wire, positioned on the support shaft along with a tensioning device and first and second stop members.

Referring now to FIGS. 2, 10 and 11, the cable guide system 10 also includes the support shaft 68. The support shaft 68 is aligned approximately horizontal between the pair of brackets 48 and 50 on a longitudinal central axis $X_1$-$X_1$. The support shaft 68 includes a first member 70 having a first end 72 and a second end 74, and a second member 76 having a first end 78 and a second end 80. The support shaft 68 can be an elongated axial member with or without a constant diameter. The support shaft 68 could also be a hollow pipe, a square or rectangular bar with a cylindrical section or be formed into some other shape. In FIGS. 10 and 11, the support shaft 68 is shown as consisting of two L-shaped members. The first member 70 can have an L-shaped configuration by securing, such as by welding, a post 82 to or adjacent to the first end 72. The post 82 can have any geometrical shape but desirably is cylindrical. Desirably, the post 82 is secured at a 90 degree angle to the remainder of the first member 70. However, it should be understood that the post 82 can be secured at any desired angle. The post 82 is sized and shaped to be removably attached to the first cavity 62 of the bracket 48. For example, the post 82 can be inserted down into the cavity 62 from the top. The post 82 can be partially inserted into the first cavity 62 or extend completely through the first cavity 62 such that the remainder of the first member 70 will rest against the upper edge of the first cavity 62. The post 82 could be made to rotate within the first cavity 62, if desired, but this is not required.

The second end 74 of the first member 70 has an elongated hollow cavity 84 formed therein. Alternatively, the elongated hollow cavity 84 could extend through the entire length of the first member 70. For example, the first member 70 could be a pipe. The elongated hollow cavity 84 extends along the longitudinal central axis $X_1$-$X_1$. Desirably, the elongated hollow cavity 84 extends over a length of the first member 70 for several inches, more desirably, for at least about 8 inches. As depicted in FIGS. 10 and 11, the first end 78 of the second member 76 is sized and shaped to slide in or telescopically engage with the elongated hollow cavity 84 formed in the first member 70. This feature allows the length of the support shaft 68 to be lengthened or shortened within limits to span across the pair of spaced apart vertical members 16 and 18 of the mold forming and extruding machine 12. Because of this, the cable guide system 10 is adjustable and can be attached to essentially all of the various models of mold forming and extruding machines 12 on the market today.

As stated above, the first and second members, 70 and 76 respectively, cooperate to enable the support shaft 68 to vary in length so that it can be attached to different models of mold forming and extruding machines 12. Just as the post 82 of the first member 70 is designed to be removably attached to the first cavity 62 of the bracket 48, a post 86 secured to the second member 76 is designed to be removably attached to the first cavity 62 of the bracket 50. The post 86 can be secured to the second member 76 in a similar fashion as the post 82 was secured to the first member 70. Desirably, the posts 82 and 86 are inserted down into the corresponding first cavities 62 of the pair of brackets 48 and 50, and can be lifted upward and out of the corresponding first cavities 62 when one wishes to remove the support shaft 68. When an L-shaped configuration is utilized for the second member 76, the post 86 can be secured to or adjacent to the second end 80. Like the post 82, the post 86 can have any geometrical configuration but desirably is cylindrical. The post 86 is shown being secured at a 90 degree angle to the remainder of the second member 76. However, it should be understood that the post 86 can be secured at any desired angle. The post 86 is removably attached to the first cavity 62 of the bracket 50. Desirably, the post 86 can be inserted into a portion of the first cavity 62 or extend completely through the first cavity 62. The post 86 can be shaped to rotate within the first cavity 62, if desired, but this is not required.

It should be understood that the support shaft 68 can be easily lifted up and removed from the pair of first cavities 62, 62 without removing or adjusting the pair of brackets 48 and 50.

Still referring to FIG. 10, the elongated hollow cavity 84 has an inner surface 88 which is sized to be slightly larger than an outer surface 90 of the second member 76. The inner and outer surfaces, 88 and 90 respectively, can have any configuration but desirably are cylindrical, each having a predetermined diameter. The amount of clearance between the inner and outer surfaces, 88 and 90 respectively, can vary. For example, this clearance can range from between about 0.01 inches to about 0.1 inches. Desirably, the clearance can range from between about 0.02 inches to about 0.08 inches. It is most satisfactory if the fit between the inner and outer surfaces, 88 and 90 respectively, is a snug sliding fit.

The first and second members, 70 and 76 respectively, cooperate to span between the pair of spaced apart vertical members 16 and 18 of the mold forming and extruding machine 12. For example, the second member 76 can extend into the elongated hollow cavity 84 from between about two to about eight inches. This means that the support shaft 68 can be shortened or lengthened several inches without compromising the integrity of the support shaft 68 to perform its intended function. It should be understood that the second member 76 could extend into the elongated hollow cavity 84 by a greater amount, say up to 16 inches, whereby the support shaft 68 could be shortened or lengthened accordingly.

With the second member 76 completely inserted into the elongated hollow cavity 84, the support shaft 68 will have a minimum length. This minimum length can be any desired distance but desirably should be at least about 24 inches.

Still referring to FIG. 10, the first member 70 is shown having an outer periphery which is desirably circular along its length. The first member 70 has one or more apertures 92 formed therein. Desirably, a plurality of spaced apart apertures 92 are formed therein. The number of apertures 92 formed in the first member 70 can vary but at least two apertures 92, 92 are required. Six apertures 92 are depicted along the length of the first member 70 in FIG. 10. The apertures 92 can be equally spaced from one another or be randomly spaced relative to one another. The apertures 92 can vary in size and configuration but desirably are all of the same size and configuration. The apertures 92 are shown as being non-threaded cylindrical openings but could very well be threaded openings. The apertures 92 can also be tapered, if desired. More desirably, each of the apertures 92 is circular having a constant diameter. The diameter of each aperture 92 can be about 0.2 inches or less. The apertures 92 can extend partially into the first member 70 or extend completely therethrough, as depicted. Desirably, each aperture 92 will extend into the first member 70 to a depth of at least about 0.5 inches. Each of the apertures 92 is designed to receive an engaging member that will be explained below.

Referring now to FIG. 11, the cable guide system 10 further includes a first stop member 94 which is removably secured to the support shaft 68. The first stop member 94 can be of various designs and structure. For example, the first stop member 94 can be a locking mechanism, a removable elongated pin, a cotter pin, a pin having a safety loop or harness secured to it, a tapered elongated stud, a threaded bolt having an attachable nut, etc. In FIG. 11, the first stop member 94 is depicted as a pin 96 having an angled arm 98 extending from it. The pin 96 and/or the shape and size of the aperture 92 can be formed such that the pin 96 can lock or be secured to the aperture 92 when it is rotated a set number of degrees, for example about 30 degrees. For example, the pin 96 and/or the aperture 92 can be shaped to have a shoulder that engages in a groove once the pin 96 is rotated a certain number of degrees. Alternatively, the first stop member 94 can be a cylindrical pin that easily slides into the aperture 92 but will be retained in place by a tensioning device which will be explained shortly. Those skilled in the art will know of various other designs and structures that can accomplish the same function. The first stop member 94 can be inserted into any of the apertures 92. As depicted, the first stop member 94 is inserted into the left most aperture 92. A washer 100 is slid onto the first member 70 when it is separated from the second member 76. The washer 100 is positioned adjacent to the first stop member 94. The washer 100 is not required but is advantageous to the present assembly.

Figure 12:
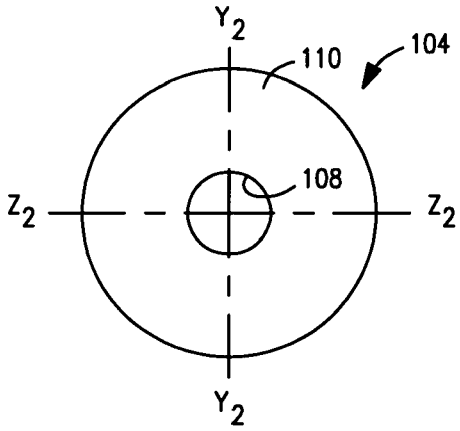
FIG. 12 is a side view of a spool showing a circular central aperture formed therethrough.

Referring now to FIGS. 11 and 12, the cable guide system 10 also includes a tensioning device 102. The tensioning device 102 is slid or mounted onto the first member 70. The tensioning device 102 can be constructed in various forms. As depicted, the tensioning device 102 can be a simple device such as a spring or be a complex mechanical member including several movable parts. When the tensioning device 102 is a spring, it can be a helical spring, a coil spring or a combination of two or more similar or different springs. Desirably, the tensioning device 102 is a single helical spring. When the tensioning device 102 is a spring, its diameter, length and spring force can vary.

The cable guide system 10 further includes one, two or more spools 104. Each spool 104 has a longitudinal central axis $X_2$-$X_2$, a vertical central axis $Y_2$-$Y_2$ and a transverse central axis $Z_2$-$Z_2$, see FIG. 12. The longitudinal central axis $X_2$-$X_2$ is coaxially aligned with the longitudinal center line $X_1$-$X_1$ of the support shaft 68, see FIG. 11. Each spool 104 is capable of holding and retaining a quantity of flexible reinforcement cable or wire 106. By "flexible" it is meant that the cable or wire 106 is pliable and capable of being bent or flexed repeatedly without damage. By "reinforcement" it is meant the act or process of reinforcing or the state of being reinforced. The amount of cable or wire 106 retained on each spool 104 can vary but should be at least 25 feet in length. Desirably, each spool 104 can hold at least 100 feet of cable or wire 106. More desirably, each spool 104 can hold at least 150 feet of cable or wire 106. Even more desirably, each spool 104 can hold from between about 200 to about 1,000 feet of cable or wire 106.

The flexible reinforcement cable or wire 106 can be formed from various materials, including but not limited to: metal, a ferrous metal, a non-ferrous metal, steel, galvanized steel, aluminum, copper, titanium, a composite formed from two or more materials, a plastic, a thermoplastic, graphite, fiberglass, several intertwined fiberglass strands, as well as other materials known to those skilled in the art. The flexible reinforcement cable or wire 106 can also be formed from two or more different materials. The flexible reinforcement cable or wire 106 is continuous on each spool 104 and has a predetermined length. The actual length will vary depending upon the dimensions of the spool 104 and the diameter of the cable or wire 106.

It should be understood that the cable guide system 10 will work satisfactorily with a single spool 104. For some larger jobs, two spools 104, 104 will work better. For those jobs where two different size flexible reinforcement cables or wires 106 are required to be inserted into the extruded mold, two spools 104, 104 work best.

Typically, each spool 104 has a central aperture 108 formed therein, see FIG. 12. Each spool 104 also has a pair of spaced apart and upwardly extending sides 110, 110. The central aperture 108 is sized and shaped to slide over the first member 70. If the first member and second members, 70 and 76 respectively, are L-shaped, then they will have to be separated from one another before the spool 104 can be slid onto the first member 70. Desirably, the central aperture 108 is circular in shape and has a diameter slightly larger than the diameter of the first member 70. For example, the central aperture 108 can have a diameter ranging from between about 1.1 inches to about 1.25 inches while the first member 70 has an outside diameter of about 1 inch. The two upstanding sides 110, 110 can be of any geometrical shape but desirably are circular in configuration. The upstanding sides 110, 110 can have any diameter but desirably will have a diameter of about 15 inches or less. Desirably, the upstanding sides 110, 110 will have a diameter ranging from between about 6 inches to about 13 inches. More desirably, the upstanding sides 110, 110 will have a diameter ranging from between about 8 inches to about 12 inches. Each spool 104 can vary in width w. Typically, each spool 104 will have a width w ranging from between about 2 inches to about 12 inches. Desirably, each spool 104 will have a width w ranging from between about 2 inches to about 8 inches. More desirably, each spool 104 will have a width w ranging from between about 3 inches to about 6 inches.

The flexible reinforcement cable or wire 106 coiled onto each of the spools 104 can vary in diameter. Typically, the diameter of the cable or wire 106 is equal to or less than about 0.5 inches. Desirably, the cable or wire 106 has a diameter equal to or less than about 0.375 inches. More desirably, the cable or wire 106 has a diameter equal to or less than about 0.25 inches. Even more desirably, the cable or wire 106 has a diameter equal to or less than about 0.15 inches.

In FIG. 11, two spools 104 are shown positioned on the first member 70 in a side by side fashion. It should be understood that the cable guide system 10 of this invention can be used with a single spool 104, with two spools 104, 104, or with three or more spools 104. The number of spools 104 that can be used will depend upon the width w of each spool 104, as well as on the overall length of the support shaft 68. Typically one or two spools 104,104 are adequate for most curb and edging jobs. The spools 104, 104 can easily be replaced when they become empty or if a different size cable or wire 106 is required for a particular task. A spool 104 can also be replaced with a new spool 104 that contains a different grade of cable or wire 106.

The left most spool 104 is slid on the first member 70 until it contacts the tensioning device 102. An optional washer 112 can be positioned between the tensioning device 102 and the left most spool 104, if desired. Still another washer 114 is slid onto the first member 70 after the spools 104, 104 are positioned on the first member 70. The washer 114 is positioned on the opposite side of the right most spool 104. The washers 112 and 114 are slid onto the first member 70 when it is separated from the second member 76. The washer 114 abuts against the right side of the right most spool 104. If only one spool 104 is utilized, the washer 114 will abut against its right side. The tensioning device 102 is capable of applying a predetermined tension against the adjacent spool 104 to prevent the flexible reinforcement cable or wire 106 from prematurely unraveling. The amount of force or pressure that the tensioning device 102 can exert against the adjacent spool 104 can vary. Typically, the tensioning device 102 can apply up to about 25 pounds per square inch (psi) of resistance against the adjacent spool 104. Desirably, the tensioning device 102 can apply from between about 1 psi to about 20 psi of resistance against the adjacent spool 104. More desirably, the tensioning device 102 can apply from between about 2 psi to about 15 psi of resistance against the adjacent spool 104. Even more desirably, the tensioning device 102 can apply from between about 3 psi to about 10 psi of resistance against the adjacent spool 104. When the two spools 104, 104 are arranged side by side and are physically touching one another, the tensioning device 102 will be able to apply resistance to both of the spools 104, 104 at the same time.

Still referring to FIG. 11, the cable guide system 10 also includes a second stop member 116. The second stop member 116 can be identical to or different from the first stop member 94. The second stop member 116 is depicted as being identical to the first stop member 94 in that it includes a pin 118 having an angled arm 120 extending outward therefrom. The second stop member 116 can function in the same way as the first stop member 94. For example, by rotating the second stop member 116 through a certain angle, it can be locked to the aperture 92 into which it is inserted. Alternatively, the second stop member 116 can be a simple pin that is inserted into one of the apertures 92 and is retained in the aperture 92 by the axial pressure exerted by the tensioning device 102.

One can now understand why one or more apertures 92 are formed in the first member 70. The cable guide system 10 will work with one aperture 92 provided the opposite side 110 of the spool 104 contacts the vertical member 18. Desirably, two of the apertures 92 will be used to hold the spool 104 in place. The presence of multiple apertures 92 allow one or more spools 104, 104 to be positioned on the support shaft 68. After the second stop member 116 is inserted into an aperture 92, the second member 76 is slid into the elongated hollow cavity 84 of the first member 70. In this arrangement, the support shaft 68 is ready to be attached to the pair of brackets 48 and 50. The support shaft 68 should be secured to the pair of brackets 48 and 50 such that it is aligned horizontal on the mold forming and extruding machine 12.

Figure 13:
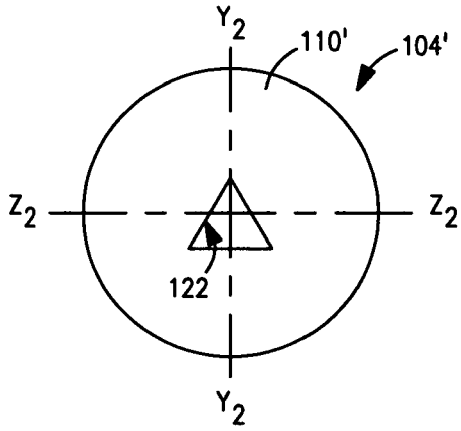
FIG. 13 is a side view of an alternative spool showing a triangularly shaped central aperture formed therethrough.
Figure 14:
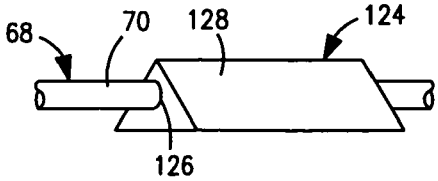
FIG. 14 is a perspective view of a bushing having a circular central aperture formed therethrough and a triangular exterior surface so as to fit the triangular central aperture formed in the spool shown in FIG. 13.

Referring now to FIGS. 13 and 14, an alternative spool 104' is depicted having a central aperture 122 with a unique geometrical shape. In FIG. 13, the central aperture 122 has the shape of a triangle. The spool 104' is otherwise similar to the spool 104 described above. The spool 104' has a pair of spaced apart and upstanding sides 110' and 110', one of which is shown. By changing the geometrical shape of the central aperture 122, one can limit the number of spools 104' that will work on the cable guide system 10. One can control the quality of the cable and wire 106 on each replacement spool 104' by limiting the number of such spools 104' that can be positioned on the support shaft 68. Therefore, replacement spools 104', 104' may have to be purchased from the original equipment manufacturer or from another source which can manufacture and sell such uniquely designed spools 104'.

Since the spools 104 and 104' are designed to rotate in a smooth motion on the stationary support shaft 68 as the cable or wire 106 is withdrawn or unwound, it is necessary to utilize a bushing 124 when the central aperture does not match the circular shape of the support shaft 68. In FIG. 14, the bushing 124 contains a central aperture 126 having an inner surface sized and shaped to conform to the outer periphery of the first member 70. The central aperture 126 extends completely through the bushing 124. The central aperture 126 is sized to easily slide onto the outer periphery of the first member 70 of the support shaft 68. The bushing 124 can be closely fitted to the first member 70 but is designed to rotate thereon as the support shaft 68 remains stationary. The bushing 124 has a triangular outer surface 128 which closely matches the inner surface of the central aperture 122. The triangular outer surface 128 is sized and shaped to conform to the inner periphery of the central aperture 122 of the spool 104'. Once the spool 104' is positioned on the bushing 124, it will be able to freely rotate as the reinforcement cable or wire 106 is unwound therefrom.

Figure 15:
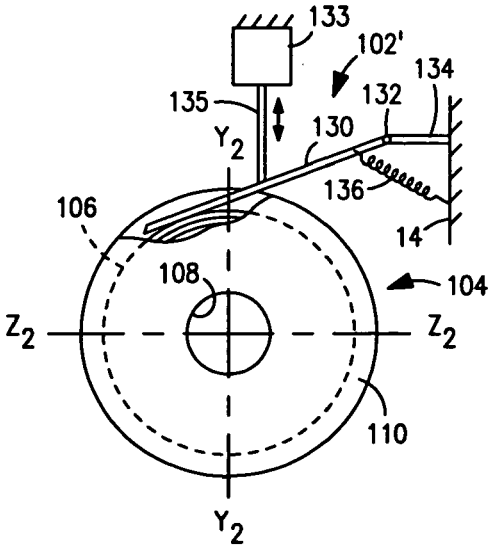
FIG. 15 is a side view of an alternative embodiment showing a partial cut away of a tension loaded lever contacting the flexible reinforcement cable or wire and being pivotably attached to a portion of the frame of the mold forming and extruding machine.

Referring to FIG. 15, an alternative embodiment of a tensioning device 102' is shown. This tensioning device 102' can be substituted for the tensioning device 102, explained above. The tensioning device 102' includes a movable lever 130 attached at a pivot point 132 to an arm 134. The arm 134 in turn is secured to a portion of the frame 14 of the mold forming and extruding machine 12. The lever 130 is tension loaded by a spring 136, such as a coil spring, which is secured between the frame 14 and the lever 130. The amount of force exerted by the spring 136 can be adjusted by controlling the diameter and length of the spring 136, as well as the material the spring 136 is constructed of, and the density of the coils per linear inch. The tensioning device 102' can also include a brake 133 having a movable arm 135 that can be connected to the lever 130. When the brake 133 is applied, none of the flexible reinforcement cable or wire 106 on the spool 104 can be unwound. The movable lever 130 should apply a force of at least 2 pounds per square inch (psi) against the flexible reinforcement cable or wire 106 to prevent the flexible reinforcement cable or wire 106 from prematurely unraveling while allowing the flexible reinforcement cable or wire 106 to be easily unwound from the spool 104 or 104'. The pivotal lever 130 is positioned to contact and impinge upon the outer most surface of the flexible reinforcement cable or wire 106 wound on the spool 104 or 104'. The width of the lever 130 can be slightly less than the width w of the spool 104 or 104' which it interacts with. Alternatively, the pivotal lever 130 can be constructed to move sideways, back and forth on the spool 104 or 104' as the flexible reinforcement cable or wire 106 is unwound from the spool 104 or 104'.

It should be understood that those skilled in the art will know of various other mechanisms that can be utilized to apply tension onto the flexible reinforcement cable or wire 106 as it is being unwound from the spools 104 or 104'.

Figure 16:
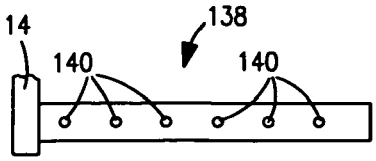
FIG. 16 is a front view of a guide member secured to a portion of the frame of the mold forming and extruding machine and which contains one or more apertures formed therethrough.

Referring now to FIGS. 2, 3 and 16, the cable guide system 10 further includes a guide member 138 secured to the frame 14 of the mold forming machine 12. The guide member 138 can vary in shape and design. The guide member 138 is secured to the frame 14 at a location below and forward of the spool 104 or 104' and in horizontal alignment with the plunger 34. The guide member 138 can be spaced at an equal distance from the spools 104 or 104' and from the plunger 34. Desirably, the guide member 138 is spaced at a farther distance from the spools 104 or 104' than from the plunger 34. The guide member 138 should be spaced at least 18 inches below the spools 104 or 104' and at least 12 inches rearward of the plunger 34. The guide member 138 should be at least 12 inches forward of the vertical central axis $Y_2$-$Y_2$ of the spool 104 or 104'. Desirably, guide member 138 should be spaced at least 20 inches below the spools 104 or 104', at least 16 inches rearward of the plunger 34 and at least 10 inches forward of the vertical central axis $Y_2$-$Y_2$ of the spool 104 or 104'. More desirably, guide member 138 should be spaced at least 24 inches below the spools 104 or 104', at least 18 inches rearward of the plunger 34 and at least 8 inches forward of the vertical central axis $Y_2$-$Y_2$ of the spool 104 or 104'. The guide member 138 functions to change the orientation of the flexible reinforcement cable or wire 106 which is being unwound from the spool 104 or 104'. The guide member 138 changes the orientation of the flexible reinforcement cable or wire 106 from a vertical orientation to a horizontal orientation. The guide member 138 is capable of changing the orientation of the flexible reinforcement cable or wire 106 by at least about 45 degrees, desirably by at least about 60 degrees, more desirably, by at least about 75 degrees, and most desirably, by at least 90 degrees. The guide member 138 could change the orientation of the flexible reinforcement cable or wire 106 up to about 150 degrees.

In FIG. 16, the guide member 138 is depicted as an elongated bar aligned approximately horizontal to the support shaft 68. The guide member 138 has one or more apertures 140 formed therethrough. Desirably, two or more spaced apart apertures 140 are present in the guide member 138. When two apertures 140, 140 are formed in the guide member 138, it will be able to receive a flexible reinforcement cable or wire 106 from each of the two spools 104, 104 or 104', 104' which can be mounted on the support shaft 68. For maximum efficiency, each of the apertures 140, 140 should be aligned parallel to the support shaft 68 and at an elevation in line with the plunger 34. Desirably, each of the apertures 140, 140 has a central axis that is aligned horizontally and parallel to the transverse central axis $Z_2$-$Z_2$ of the spools 104 or 104'. This is important because the guide member 138 must be capable of changing the direction of the each of the flexible reinforcement cables or wires 106 which is being unwound from the spools 104, 104 or 104' 104' from a vertical or semi-vertical orientation to an approximate horizontal orientation, see FIGS. 2 and 3. By "vertical orientation" it is meant an orientation approximately parallel to the vertical central axis $Y_2$-$Y_2$, see FIGS. 12 and 13. By "semi-vertical orientation" it is meant an orientation within 20 degrees of the vertical central axis $Y_2$-$Y_2$. The guide member 138 also functions to axially and/or horizontally align each of the flexible reinforcement cables or wires 106 being unwound from the spools 104 or 104' with a corresponding aperture 40 formed in the plunger 34. Each of the flexible reinforcement cables or wires 106 will pass through one of the apertures 40 formed through the vertical face member 36 of the plunger 34 and will be simultaneously advanced into the moldable substance 30 as it is extruded from the mold forming and extruding machine 12.

It is advantageous to size and shape each of the apertures 140 formed through the guide member 138 to match up with one of the apertures 40 formed in the plunger 34. It is also desirable to axially align one or more of the apertures 140 formed in the guide member 138 with a corresponding aperture 40 formed in the plunger 34. It should be noted that depending upon the height of the guide member 138, it may not be possible to axially align each and every aperture 140 formed in the guide member 138 with a corresponding aperture 40 formed in the plunger 34.

Figure 17:
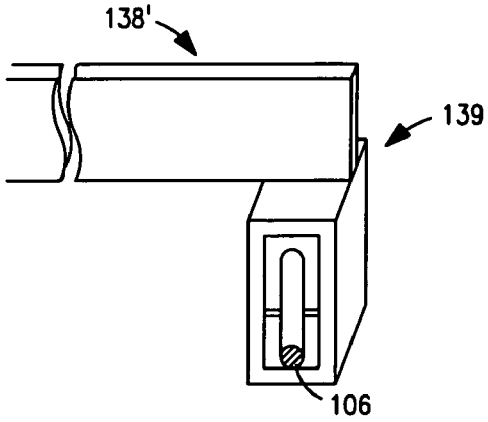
FIG. 17 is a perspective view of a pulley secured to a guide member.

Referring now to FIG. 17, an alternative guide member 138' is depicted. This alternative guide member 138' shows a pulley 139 secured to an elongated bar, such as by welding. Those skilled in the art will know of various ways to secure the pulley 139 to the bar. Standard bolts, nuts, screws, welds, adhesive, etc. could be used to form the attachment. Although only one pulley 139 is depicted, the guide member 138' could utilize two or more pulleys 139, 139 arranged side by side. Furthermore, the pulley 139 could be secured directly to the frame 14 of the mold forming and extruding machine 12, if desired. The pulley 139 is a simple machine consisting of a wheel with a grooved rim in which one of the flexible reinforcement cables or wires 106 can run so as to change its direction. The pulley 139 permits one of the flexible reinforcement cables or wires 106 to easily pass therethrough. Each pulley 139 is capable of changing the direction of the each of the flexible reinforcement cables or wires 106 which is being unwound from the spools 104, 104 or 104' 104' from a vertical or semi-vertical orientation to an approximate horizontal orientation, see FIGS. 2 and 3. Each pulley 139 will allow this directional change to occur but with less friction than may be present by using the apertures 140 formed in the guide member 138.

Each flexible reinforcement cable or wire 106 will pass through its own pulley 139. Each of the pulleys 139 will perform the same function as the apertures 140 and will align one of the flexible reinforcement cables or wires 106 with one of the apertures 140 formed in the plunger 34.

Still referring to FIGS. 2, 3 and 4, the plunger 34 is positioned forward of the guide member 138 or 138' and at least a portion of the guide member 138, 138' is aligned along a common horizontal plane with the plunger 34. Since the guide member 138 or 138' is position at least 12 inches rearward of the plunger 34, it is situated closer to the vertical central axis $Y_2$-$Y_2$ of the spool 104 or 104'. The guide member 138 or 138' can be formed from any relatively hard material including but not limited to: metal, steel, carbon steel, stainless steel, aluminum, titanium, etc.

Returning again to FIG. 16, the guide member 138 can a stationary member cut and/or formed from standard bar stock to keep the cost down. Desirably, the cross-section of the guide member 138 is rectangular or square. A rectangular cross-section is shown in FIG. 3 of the drawings. The guide member 138 has one or more spaced apart apertures 140 formed therethrough. Desirably, at least two spaced apart apertures 140 are formed through the guide member 138. More desirably, a plurality of spaced apart apertures 140 are formed through the guide member 138. In FIG. 16, six spaced apart apertures 140 are shown. The apertures 140 are sized and shaped to allow the flexible reinforcement cable or wire 106 to easily pass therethrough. Desirably, the apertures 140 are circular in configuration and each has a similar or equal diameter. The diameter of each of the apertures 140 should be at least 0.1 inches larger than the diameter of the flexible reinforcement cable or wire 106 which will pass through it. More desirably, the diameter of each of the apertures 140 should be at least 0.25 inches larger than the diameter of the flexible reinforcement cable or wire 106 which will pass through it. Even more desirably, the diameter of each of the apertures 140 should be at least 0.5 inches larger than the diameter of the flexible reinforcement cable or wire 106 which will pass through it.

Referring again to FIGS. 1-3, almost every mold forming and extruding machine 12 has a connecting rod 29 which is part of the steering mechanism 25. The connecting rod 29 is usually located vertical above and rearward of the guide member 138. The connecting rod 29 is a stationary member. Desirably, the connecting rod 29 has a cylindrical shape. The connecting rod 29 can have a diameter ranging from between about 0.25 inches to about 1 inch. The connecting rod 29 can be attached at each end by a pair of threaded bolts 142, 144 to a pair of arms 146, 146. The pair of arms 146, 146 can be secured to the frame 14, such as by welds, and desirably each of the pair of arms 146, 146 extends rearward from the vertical members 16 and 18. Desirably, each of the pair of arms 146, 146 is secured to one of the vertical members 16 and 18 just above the wheels 20 and 22. It should be understood that the connecting rod 29 is not part of the present cable guide system 10.

Each of the flexible reinforcement cables or wires 106 can be directed downward forward or rearward of the connecting rod 29. Desirably, each of the flexible reinforcement cables or wires 106 will be located in front of the connecting rod 29. This allows the guide member 138 or 138' to change the directional orientation of the flexible reinforcement cables or wires 106 as they are unwound from the spools 104, 104.

Figure 6:
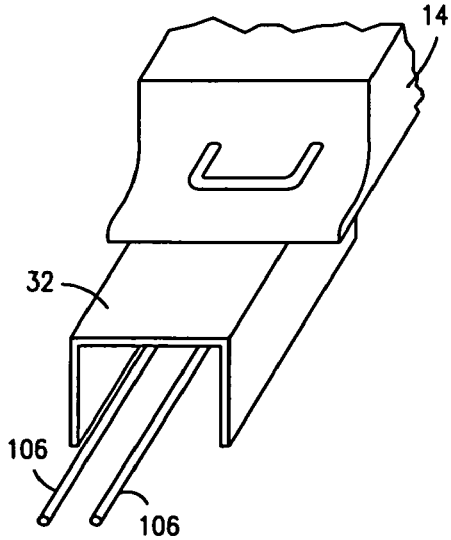
FIG. 6 is a partial perspective view of the front of the mold forming and extruding machine shown in FIG. 1 depicting a pair of reinforcement cables extending outward therefrom.

Referring again to FIGS. 1, 4 and 6, as the plunger 34 extrudes the moldable substance 30 from the mold forming and extruding machine 12, the one or more of the flexible reinforcement cables or wires 106, 106 will pass through the apertures 40, 40 formed in the plunger 34 and will be embedded within the moldable substance 30. The flexible reinforcement cables or wires 106, 106 will advance out of the tunnel shaped mold 32 at the same time as the moldable substance 30 is extruded. As the moldable substance 30 hardens and cures, it will hold and lock each of the flexible reinforcement cables or wires 106, 106 in place. Typically, the moldable substance 30 can cure within eight hours or less at a temperature of about 70 degrees Fahrenheit. Once the moldable substance 30 has been extruded into the desired shape and length, the flexible reinforcement cables or wires 106, 106 are cut using a wire cutter or by some other means. The flexible reinforcement cables or wires 106, 106 are usually cut or severed away from the mold forming and extruding machine 12 such as in front of the tunnel shaped mold 32. At this point, the remaining portion of each of the flexible reinforcement cables or wires 106, 106 can be rewound onto the spools 104, 104 or 104', 104' by rotating the spools 104 or 104' in a reverse direction, such as by hand. The tensioning device 102 or 102' will serve to prevent the flexible reinforcement cables or wires 106, 106 from unraveling while they are wound back onto the spools 104, 104 or 104', 104'. Alternatively, the flexible reinforcement cables or wires 106, 106 can be left in place in the machine 12, such that they will be ready for the next job.

Figure 18:
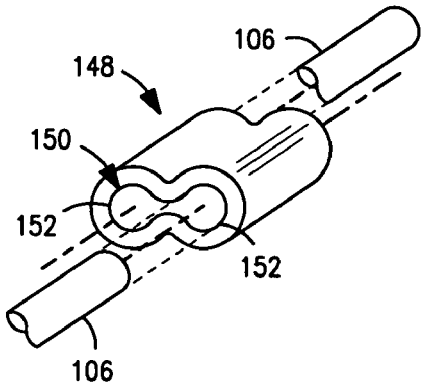
FIG. 18 is a cable connector with a pair of apertures formed therethrough which can be crimped to join the terminal end of a flexible reinforcement cable unwound from one of the spools to the leading end of a flexible reinforcement cable unwound from another spool.

Referring now to FIG. 18, a cable connector 148 is shown which can be used to secure two different flexible reinforcement cables or wires 106, 106 together. The cable connector 148 has an aperture 150 formed therethrough. The aperture 150 has a generally hourglass shape with a pair of enlarged sections 152, 152. Each of the enlarged sections 152, 152 is sized to receive one end of a flexible reinforcement cable or wire 106. The cable connector 148 functions to join and secure the terminal end of one of the flexible reinforcement cables or wires 106 from one of the spools 104 or 104' to a starting end of a flexible reinforcement cable or wire 106 from the another spool 104 or 104'. In the situation where the flexible reinforcement cable or wire 106 from one spool 104 or 104' runs out before the molded curb or edging is finished, the operator can position the trailing end of the first flexible cable or wire 106 in one of the enlarged sections 152, 152 of the cable connector 148 and position the starting or free end of a second flexible reinforcement cable or wire 106 into the other enlarged section 152 of the cable connector 148. The operator then uses a pair of pliers to squeeze or crimp the cable connector 148 onto each of the flexible reinforcement cables or wires 106, 106. The cable connector 148 will hold the two cables or wires 106, 106 secure to one another. The cable connector 148 should be secured in place on the two flexible reinforcement cables or wires 106, 106 forward of the tunnel shaped mold 32. This location is important, because the size of the cable connector 148 may not allow it to pass through one of the apertures 40 formed in the plunger 34.

Method

A method of using a cable guide system 10 with a mold forming and extruding machine 12 to guide and embed one or more flexible reinforcement cables or wires 106, 106 in a compacted and moldable substance 30 will now be explained with reference to FIGS. 1-3, 18 and 19. The mold forming and extruding machine 12 includes a pair of spaced apart vertical members 16 and 18, a hopper 28, an engine or motor 42 connected to a drive mechanism 44, which in turn operates a reciprocating ram 46 connected to a plunger 34. The plunger 34 has at least one aperture 40 formed therein through which the flexible reinforcement cable or wire 106 can pass. The plunger 34 is designed to reciprocate within a tunnel shaped mold 32 such that a moldable substance 30 can be extruded therefrom. The cable guide system 10 is designed to be attached to the machine 12 during initial assembly by the manufacturer or by the owner of the machine 12 after he has purchased the machine 12. The cable guide system 10 includes a support shaft 68 aligned horizontally on the machine 12 and secured to the pair of spaced apart vertical members 16 and 18. The support shaft 68 includes a first member 70 and a second member 76. The first member 70 has a first end 72 which can be removably attached to one of the vertical members 16 or 18 and a second end 74 which has an elongated hollow cavity 84 formed therein. The second member 76 has a first end 78 which is sized and shaped to engage with the elongated hollow cavity 84 and a second end 80 which can be removably attached to the other vertical member 16 or 18. The first and second members, 70 and 76 respectively, cooperate to vary the length of the support shaft 68 so that it can accommodate and fit various machine models.

The cable guide system 10 also includes a first stop member 94 secured to the support shaft 68. One or more spools 104 or 104' are sized to slide over the support shaft 68. Typically, two spools 104 or 104' are positioned on the support shaft 68 at the same time. Each spool 104 or 104' contains a quantity of flexible reinforcement cable or wire 106 and has a central aperture 108 or 122 formed therethrough. The cable guide system 10 further includes a tensioning device 102 or 102' positioned on the support shaft 68 which cooperates with the first stop member 94 and contacts one of the spools 104 or 104'. The tensioning device 102 or 102' is capable of applying a predetermined tension against the adjacent spool 104 or 104' to prevent the flexible reinforcement cable or wire 106 from prematurely unraveling. The tensioning device 102 or 102' can be adjusted to apply a force of up to about 25 pounds per square inch of resistance against the spool 104 or 104'. If a pair of spools 104, 104 or 104', 104' is present, the tensioning device 102 can apply a tension which will impact both spools 104, 104 or 104',104'. The cable guide system 10 also includes a second stop member 116 secured to the support shaft 68 on an opposite side of the spool 104 or 104'. If a pair of spools 104,104 or 104',104' is present, the second stop member 116 will be located adjacent to the spool 104 or 104' which is located away from the first stop member 94. Lastly, the cable guide system 10 includes a guide member 138 secured to the machine 12 at a location below and forward of the one or more spools 104 or 104' and in horizontal alignment with the plunger 34. The guide member 138 has one or more apertures 140 formed therein. The plunger 34 is positioned within the tunnel shaped mold 32 located at the front of the machine 12 and is designed to reciprocate therein. As the plunger 34 advances on its forward stroke, the moldable substance 30 is extruded out of the tunnel shaped mold 32 at the same time as the flexible reinforcement cable or wire 106 is withdrawn from the spools 104 or 104'.

Figure 19:
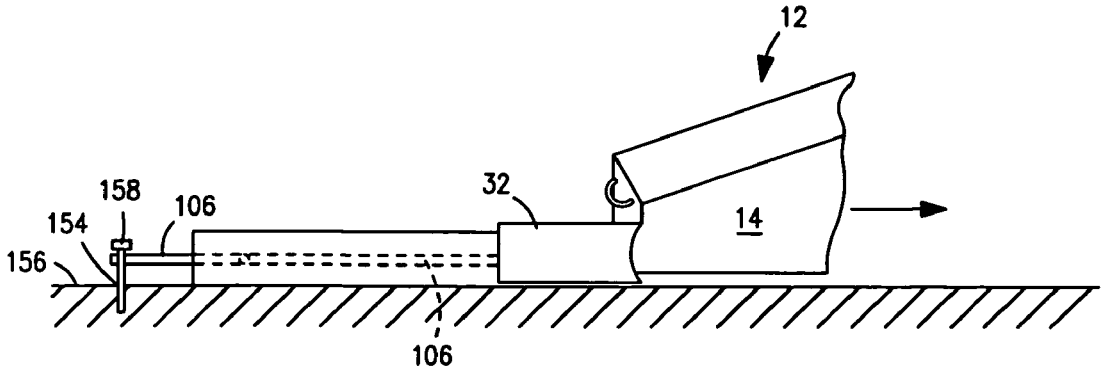
FIG. 19 is an elevation view showing a stake driven into the ground and having the free end of a flexible reinforcement cable or wire attached thereto such that a mold forming and extruding machine can move backward away from the stake while it extrudes a curb or edge with the reinforcing cable embedded therein.

Still referring to FIG. 19, the method of using the cable guide system 10 includes the steps of unwinding the flexible reinforcement cable or wire 106 from each of the spools 104 or 104'. If two spools 104, 104 or 104', 104 are present, two flexible cables or wires 106, 106 will be passed through the machine 12 and will be embedded in the moldable substance 30 once it hardens and cures. The free or starting end of each of the flexible reinforcement cables or wires 106, 106 is passed through one of the apertures 140,140 formed in the guide member 138 or through one of the pulleys 139 of the alternative guide member 138'. The guide member 138 or 138' is capable of changing the direction of each of the lo flexible reinforcement cables or wires 106, 106 which are unwound from the spools 104, 104 or 104', 104' from a vertical or a semi-vertical orientation to an approximately horizontal orientation. After passing through the guide member 138 or 138', the free or starting end of each of the flexible reinforcement cables or wires 106, 106 is advanced through one of the apertures 40, 40 formed in the plunger 34. The flexible reinforcement cables or wires 106, 106 are axially aligned between an aperture 40 formed in the plunger 34 and an aperture 140 or pulley 139 formed in the guide member 138 or 138', respectively.

The method further involves the step of securing the free or starting end of each of the flexible reinforcement cables or wires 106, 106 at a predetermined location 154 in the ground 156. Each of the flexible reinforcement cables or wires 106, 106 can be secured using various techniques. For example, a stake 158 could be driven or pushed into the ground 156 my using a hammer or some other blunt object before the flexible reinforcement cable or wire 106 is attached to it. Alternatively, the flexible reinforcement cable or wire 106 can be attached to the stake 158 and then the stake 158 can be driven into the ground 156. Another option is to have a person hold or retain the free end of the flexible reinforcement cable or wire 106 until the moldable substance 30 is extruded from the tunnel shaped mold 32 and encloses the flexible reinforcement cable or wire 106 within it. The flexible reinforcement cable or wire 106 should be positioned from between about 1 inch to about 18 inches above the ground 156 when it is attached to the stake 158. Desirably, the flexible reinforcement cable or wire 106 should be positioned from between about 1 inch to about 10 inches above the ground 156 when it is attached to the stake 158. More desirably, the flexible reinforcement cable or wire 106 should be positioned from between about 2 inches to about 6 inches above the ground 156 when it is attached to the stake 158. Even more desirably, the flexible reinforcement cable or wire 106 should be positioned from between about 2 inches to about 4 inches above the ground 156 when it is attached to the stake 158.

Once each of the flexible reinforcement cables or wires 106 is secured at a predetermined location 154, the engine or motor 42 of the machine 12 can be started and power can be conveyed to the plunger 34 via the drive mechanism 44 and the reciprocating ram 46. The moldable substance 30 is manually deposited into the hopper 28 and is routed down into the tunnel shaped mold 32 when the plunger 34 is in its rearward position. As the plunger 34 is moved forward, the moldable substance 30 is extruded through the tunnel shaped mold 32 and out the front of the machine 12. The moldable substance 30 surrounds the flexible reinforcement cable or wire 106 which also is withdrawn from the spools 104 or 104' as the machine 12 is propelled backward away from the stake 158. The forward motion of the plunger 34 causes the machine 12 to be urged backward in a sequential fashion. Depending on the size of the tunnel shaped mold 32, the stroke of the reciprocating ram 46, and the type of moldable substance 30 being extruded, the machine 12 can extrude from between about 2 inches to about 24 inches of moldable substance 30 with each forward stroke of the plunger 34. Desirably, the machine 12 can extrude from between about 5 inches to about 18 inches of moldable substance 30 with each forward stroke of the plunger 34. More desirably, the machine 12 can extrude from between about 6 inches to about 12 inches of moldable substance 30 with each forward stroke of the plunger 34.

As the machine 12 moves backward, the operator can control the direction of the machine 12 by the steering mechanism 25 and adjust the elevation of the machine 12 by rotating the handles 24 and 26. The operator can steer the machine 12 with the steering mechanism 25 to form a linear or non-linear mold design. The machine 12 is guided backward by the operator as the moldable substance 30 is extruded out of the tunnel shaped mold 32.

The method of using the cable guide system 10 with a mold forming and extruding machine 12 can be modified such that when a pair of spools 104, 104 or 104', 104' are positioned on the support shaft 68, only one of the flexible reinforcement cables or wires 106 is initially passed through the apertures 40 and 140, formed in the plunger 34 and the guide member 138, respectively. When the flexible reinforcement cable or wire 106 is completely withdrawn from the first spool 104 or 104', the trailing end of this flexible reinforcement cable or wire 106 is secured to a leading or free end of the flexible reinforcement cable or wire 106 which is unwound from the other spool 104 or 104'. The trailing end of the first flexible reinforcement cable or wire 106 is secured to the leading or free end of a second flexible reinforcement cable or wire 106 by a cable connector 148. The cable connector 148 is attached at a location downstream of the plunger 34 and desirably in front of the tunnel shaped mold 32.

Lastly, referring to FIGS. 12 and 13, it should be understood that the geometrical configuration of the central aperture 108 formed in the spool 104 can be changed from circular to any other desired configuration. In FIG. 12, the spool 104 has a central aperture 108 with a circular configuration. In FIG. 13, the spool 104' has a central aperture 122 with a triangular configuration. When the central aperture 122 has a geometrical configuration different from a circle, one can slide a bushing 124 onto the support shaft 68. The bushing 124 has an exterior surface 128 sized and configured to match the non-circular configured central aperture 122 of the spool 104'. By sliding the non-circular configured central aperture 122 of the spool 104' onto the exterior surface 128 of the bushing 124, one can position the spool 104' on the support shaft 68 while allowing the spool 104' to rotate in a continuous fashion.

While the invention has been described in conjunction with several specific embodiments, it is to be understood that many alternatives, modifications and variations will be apparent to those skilled in the art in light of the foregoing description. Accordingly, this invention is intended to embrace all such alternatives, modifications and variations which fall within the spirit and scope of the appended claims.

We claim:

1. A cable guide system for a mold forming machine which has a pair of spaced apart vertical members, said cable guide system comprising:

a) a support shaft aligned horizontally and secured to said pair of spaced apart vertical members;

b) a first stop member secured to said support shaft;

c) a tensioning device positioned on said support shaft and cooperating with said first stop member;

d) a spool containing a quantity of flexible reinforcement cable, said spool having a central aperture formed therethrough which is sized to slide over said support shaft, and said spool cooperating with said tensioning device such that a predetermined tension can be applied against said spool to prevent said flexible cable from prematurely unraveling;

e) a second stop member secured to said support shaft on an opposite side of said spool;

f) a reciprocating plunger having a vertical face member with an outer periphery and having an aperture formed therethrough, said aperture being located completely inward from said outer periphery and being formed through a lower half of said vertical face member, and said plunger capable of expelling a moldable substance from said machine while allowing said flexible cable to pass through said aperture; and g) a guide member secured to said mold forming machine at a location below and forward of said spool and in horizontal alignment with said reciprocating plunger, and said guide member having an aperture formed therethrough which is aligned parallel to said support shaft and at an elevation in line with said reciprocating plunger.

2. A cable guide system for a mold forming machine which has a pair of spaced apart vertical members, said cable guide system comprising:

a) a support shaft aligned horizontally and secured to said pair of spaced apart vertical members, said support shaft having a first member removably attached to one of said vertical members and a second end having an elongated hollow cavity formed therein, and a second member having a first end which is sized and shaped to telescopically engage with said elongated hollow cavity and a second end removably attached to said other vertical member, said first and second members cooperating to vary the length of said support shaft so as to accommodate various machine models;

b) a first stop member secured to said support shaft;

c) a tensioning device positioned on said support shaft and cooperating with said first stop member;

d) a spool containing a quantity of flexible reinforcement cable, said spool having a central aperture formed therethrough which is sized to slide over said support shaft, and said spool cooperating with said tensioning device such that a predetermined tension can be applied against said spool to prevent said flexible cable from prematurely unraveling;

e) a second stop member secured to said support shaft on an opposite side of said spool; and f) a guide member secured to said mold forming machine at a location below and forward of said spool and in horizontal alignment with a plunger, said guide member having an aperture formed therethrough which is aligned parallel to said support shaft and at an elevation in line with said plunger, said aperture having a diameter which is at least about 0.05 inches larger than said predetermined diameter of said flexible cable, said plunger capable of expelling a moldable substance from said machine while allowing said flexible cable to pass through said aperture, said guide member capable of changing the direction of said flexible cable which is unwound from said spool from a vertical orientation to a horizontal orientation, and said guide member axially aligning said unwound cable with said aperture formed in said plunger.

3. The cable guide system of claim 2 further including a pair of brackets, each bracket having first and second spaced apart ends, an inner surface and an outer surface, each bracket being shaped to form a first cavity and a larger adjacent second cavity, said cavities extending vertically through each of said brackets and perpendicular to said inner and outer surfaces, and said second cavity capable of surrounding at least a portion of one of said spaced apart vertical members and being secured thereto by an attachment member connecting said first and second ends such that said support shaft can be maintained at a predetermined height between said vertical members.

4. The cable guide system of claim 3 wherein said first member of said support shaft has an L-shaped configuration and includes a circular post formed adjacent to said first end which is sized to engage with said first cavity of one of said pair of brackets, and said second member of said support shaft has an L-shaped configuration and includes a circular post formed adjacent to said second end which is sized to engage with said other one of said pair of brackets.

5. The cable guide system of claim 1 further including a guide member secured to said mold forming machine at a location below and forward of said spool and in horizontal alignment with said plunger, said guide member being a stationary bar having an aperture formed therethrough, and said aperture is aligned parallel to said support shaft and at an elevation in line with said plunger, said guide member capable of changing the direction of said flexible cable which is unwound from said spool from a vertical orientation to a horizontal orientation, and said guide member axially aligning said unwound cable with said aperture formed in said plunger.

6. The cable guide system of claim 5 wherein said guide member has at least two apertures formed therethrough, said plunger includes a vertical face member having an outer periphery and at least two apertures formed therethrough, each of said at least two apertures being located completely inward from said outer periphery and each being formed through a lower half of said vertical face member, and each of said at least two apertures being axially aligned with a corresponding aperture formed through said guide member.

7. The cable guide system of claim 2 wherein said tensioning device is a helical spring which is capable of applying up to about 25 pounds per square inch of resistance against said spool.

8. The cable guide system of claim 2 wherein said first member has a circular outer periphery with a plurality of spaced apart apertures formed therethrough, and said first and second stop members are removable pins each being sized to engage with one of said apertures such that one or two spools can be mounted on said support shaft.

9. The cable guide system of claim 2 further including a bushing positioned on said first member, said busing having an inner surface sized and shaped to conform to said outer periphery of said first member and an outer surface sized and shaped to conform to said inner periphery of said central aperture of said spool.

10. A cable guide system for a mold forming machine which has a pair of spaced apart vertical members, said cable guide system comprising:

a) a support shaft aligned horizontally and secured to said pair of spaced apart vertical members;

b) a first stop member secured to said support shaft;

c) a tensioning device positioned on said support shaft and cooperating with said first stop member;

d) a spool containing a quantity of flexible reinforcement cable, said spool having a central aperture formed therethrough which is sized to slide over said support shaft, and said spool cooperating with said tensioning device such that a predetermined tension can be applied against said spool to prevent said flexible cable from prematurely unraveling;

e) a second stop member secured to said support shaft on an opposite side of said spool; and f) a guide member secured to said mold forming machine at a location below and forward of said spool and in horizontal alignment with a reciprocating plunger, said guide member having an aperture formed therethrough which is aligned parallel to said support shaft and at an elevation in line with said plunger, said plunger having a vertical face member with an outer periphery and having an aperture formed therethrough, said aperture being located completely inward from said outer periphery and being formed through said vertical face member, and said plunger capable of expelling a moldable substance from said machine while allowing said flexible cable to pass through said aperture, said guide member capable of changing the direction of said flexible cable which is unwound from said spool from a vertical orientation to a horizontal orientation, and said guide member axially aligning said unwound cable with said aperture formed in said plunger.

11. The cable guide system of claim 10 further including a pair of brackets, each bracket having first and second spaced apart ends, an inner surface and an outer surface, each bracket being shaped to form a first cavity and a larger adjacent second cavity, said cavities extending vertically through each of said brackets and perpendicular to said inner and outer surfaces, and said second cavity capable of surrounding at least a portion of one of said spaced apart vertical members and being secured thereto by an attachment member connecting said first and second ends such that said support shaft can be maintained at a predetermined height between said vertical members.

12. The cable guide system of claim 11 wherein said first member of said support shaft has an L-shaped configuration and includes a circular post formed adjacent to said first end which is sized to engage with said first cavity of one of said pair of brackets, and said second member of said support shaft has an L-shaped configuration and includes a circular post formed adjacent to said second end which is sized to engage with said other one of said pair of brackets.

13. The cable guide system of claim 10 wherein said guide member is a stationary bar.

14. The cable guide system of claim 10 wherein said guide member has at least two apertures formed therethrough, said plunger includes a vertical face member having an outer periphery and at least two apertures formed therethrough, each of said at least two apertures being located completely inward from said outer periphery and each being formed through a lower half of said vertical face member, and each of said at least two apertures being axially aligned with a corresponding aperture formed through said guide member.

15. The cable guide system of claim 10 wherein said tensioning device is a helical spring which is capable of applying up to about 25 pounds per square inch of resistance against said spool.

16. The cable guide system of claim 10 wherein said first member has a circular outer periphery with a plurality of spaced apart apertures formed therethrough, and said first and second stop members are removable pins each being sized to engage with one of said apertures such that one or two spools can be mounted on said support shaft.

17. The cable guide system of claim 10 further including a bushing positioned on said first member, said busing having an inner surface sized and shaped to conform to said outer periphery of said first member and an outer surface sized and shaped to conform to said inner periphery of said central aperture of said spool.

* * * * *